United States Patent [19]

Hayes et al.

[11] B 3,981,344

[45] Sept. 21, 1976

[54] INVESTMENT CASTING MOLD AND PROCESS

[75] Inventors: Douglas R. Hayes, Vernon, Conn.; Charles M. Phipps, Ridgewood, N.J.

[73] Assignee: United Technologies Corporation, Hartford, Conn.

[22] Filed: Aug. 21, 1974

[21] Appl. No.: 499,227

[44] Published under the second Trial Voluntary Protest Program on January 27, 1976 as document No. B 499,227.

[52] U.S. Cl. ..... 164/26; 164/60; 164/361; 164/366

[51] Int. Cl.[2] ..... B22C 7/02; B22C 9/22

[58] Field of Search ..... 164/23–26, 164/34–36, 43, 60, 165, 166, 361, 365, 366

[56] References Cited

UNITED STATES PATENTS

| | | | |
|---|---|---|---|
| 2,782,476 | 2/1957 | Brennan | 164/338 |
| 2,912,729 | 11/1959 | Webb | 106/38.9 X |
| 3,627,015 | 12/1971 | Giamei | 164/23 X |
| 3,669,177 | 6/1972 | Ingalls et al. | 164/34 X |

FOREIGN PATENTS OR APPLICATIONS

| | | | |
|---|---|---|---|
| 678,035 | 8/1952 | United Kingdom | 164/34 |

*Primary Examiner*—Francis S. Husar
*Assistant Examiner*—Carl Rowold
*Attorney, Agent, or Firm*—Charles A. Warren

[57] ABSTRACT

In the manufacture of hollow cast articles such as turbine blades or vanes, the article is cast in opposed halves on opposite sides of a "strong back" or mid-section, to which wax patterns are attached for the preparation of a shell mold around the strong back and patterns. The article halves, after removal from the mold, are bonded together.

15 Claims, 9 Drawing Figures

INVESTMENT CASTING MOLD AND PROCESS

BACKGROUND OF THE INVENTION

In the investment casting of such articles as turbine blades or vanes which are hollow for cooling purpose, one main problem is to have the core, that forms the internal passages in the cast article, precisely located so as to assure a satisfactory completed cast article that can be adequately cooled. When the article is cast in a single piece involved techniques are required to inspect the finished article to determine the wall thickness or the precise location and dimensions of the internal passages. If these articles are for use in high performance gas turbine engines in aircraft, imprecision in the location of the cooling passages may cause premature blade or vane failure. The removal of the core from the finished casting may present certain difficulties since leaching techniques are required.

The copending application of Hayes et al, Ser. No. 416,563 filed Nov. 16, 1973, overcomes the inspection problem by making the mold of a precast strong-back central mold element, with opposed precast outer mold elements mounted on opposite sides of the central element. Since these three elements are made separately, careful inspection of these parts before mold assembly is possible. Further, since the vane or blade is made in opposed halves by this technique, these completed halves may also be completely inspected especially on their inner surfaces prior to bonding the opposed halves together. This arrangement is most workable but is expensive unless the cost of the mold devices by which the precast mold elements are formed can be spread over a large production run of the articles desired.

SUMMARY OF THE INVENTION

The present invention is in one sense a modification of the precast mold and techniques of said copending application since it utilizes the central mold element of that application in conjunction with the "lost-wax" process in producing a shell mold by which the articles may be cast. This concept lends itself to the efficient production of cast articles where the mold must be preheated to a high temperature before being poured, as for example in the production of columnar grained blades or vanes as described in the VerSnyder U.S. Pat. No. 3,260,505 or single crystal vanes or blades as in the Piearcey U.S. Pat. No. 3,494,709 or in casting eutectic articles as in Lemkey et al U.S. Pat. No. 3,793,010. By the present invention, the central mold element may be made of a very strong precast ceramic that is deformation resistant at high temperatures and of such a thickness as to make sure that it will retain its shape and dimensions during the preheating of the mold.

This technique has particular advantage at the present time. It permits the use of the present shell mold forming and casting expertise since the usual procedure presently employed in making precision castings from high-temperature super alloys is in the investment casting utilizing shell molds formed around wax patterns in the "lost-wax" process. The present concept utilizes this expertise in conjunction with a central precast mold element which forms a "strong-back" by which to assure precision casting of articles that will be acceptable for use, for example, in high-performance gas turbines.

According to the present invention, a precast central mold element, having on opposite sides thereof the internal configuration of the opposite halves of the hollow blade or vane (or other article) has positioned thereon wax patterns located on opposite sides and having on their outer surfaces the configurations of the outer surfaces of the blade or vane halves to be cast. This assemblage of central mold element with the wax patterns thereon is then successively dipped in a slurry stuccoed with refractory particles, and dried by well-known techniques until a mold wall is built up that is thick enough so that when dried and cured will withstand its use in making an investment casting of any of the well known high temperature super alloys, examples of which are given in the above mentioned VerSnyder patent. After the desired mold thickness of mold is obtained, it is cured and the wax patterns melted out thus readying it for use in making a casting.

Such investment casting may involve preheating this shell mold to a temperature above the melting point of the alloy being cast prior to pouring the mold. The precast central element serves as a "strong back" that is not subject to warping so that the cast vane or blade halves will have the desired configuration and be so precisely cast that the opposed halves when later assembled for bonding together will have the appropriate mating surfaces in contact over the entire design area.

The foregoing and other objects, features and advantages of the present invention will become more apparent in the light of the following detailed description of preferred embodiments thereof as illustrated in the accompanying drawing.

DESCRIPTION OF THE PREFERRED EMBODIMENT

Figure 8:
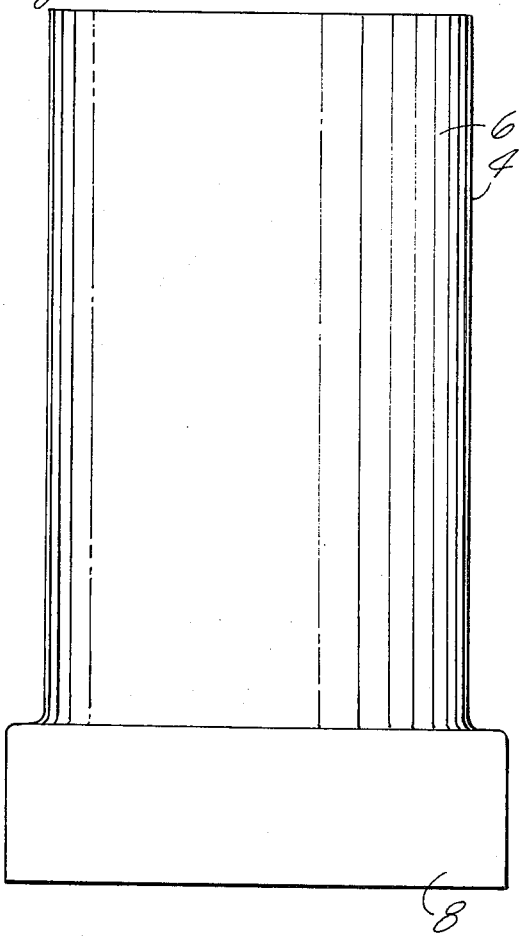
FIG. 8 is a side elevation of the finished blade of FIG. 8.

The particular article to be cast is shown by way of example as a turbine blade 4, FIG. 8, having an airfoil portion 6 and a root 8. This blade is hollow and has internal opposed surfaces 10 and 12, FIG. 9, and opposite external surfaces 14 and 15 on the opposed halves 16 and 17. It will be understood that other articles may be made by this technique, such as turbine vanes, for example, and the showing of a turbine blade is merely illustrative of one type of cast article. The technique to be described is applicable to the casting of high temperature super alloys, or eutectics examples of which are now well known.

Figure 1:
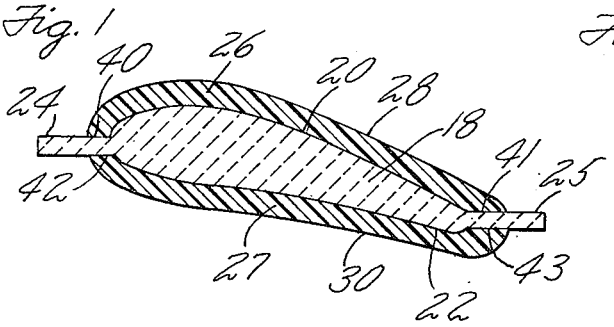
FIG. 1 is a sectional view through a central mold element with the wax pattern thereon, in readiness for forming a shell mold.

The manufacture of such articles by the present invention begins with a precast ceramic "strong back" or central mold element 18, FIG. 1, the opposite side surfaces 20 and 22 of which have the configuration of the opposed internal surfaces 10 and 12 of the cast article, since these surfaces of the cast article are formed against these surfaces of the mold element. The opposite edges of the central mold element extend beyond the surfaces 20 and 22 to form side flanges 24 and 25 that become embedded in the shell mold as will be pointed out.

Figure 2:
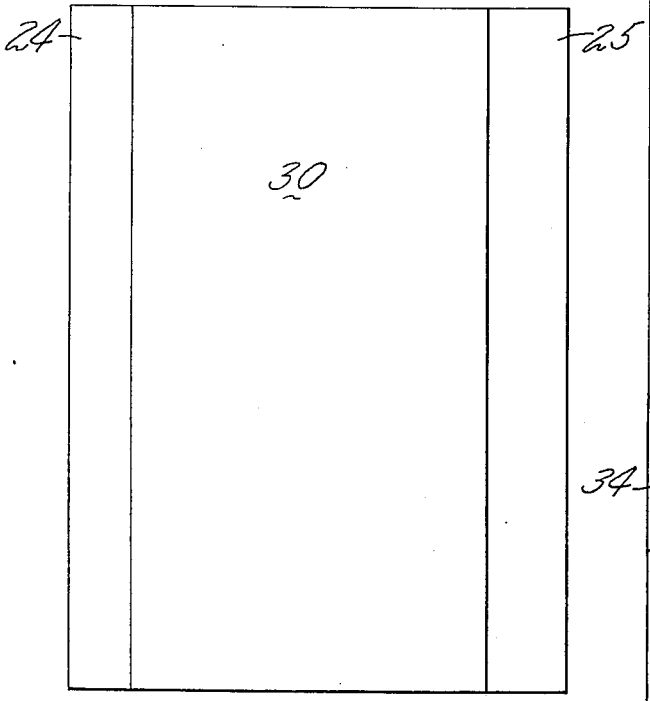
FIG. 2 is an elevation of one side of the central vane element.

On the surfaces 20 and 22 wax patterns 26 and 27 are positioned, these patterns having outer surfaces 28 and 30 conforming in shape to the outer surfaces of the finished blade halves. These wax patterns in addition to defining the airfoil portion 32 of the blade shape, and the root portion 34, also have a growth zone forming portion 36 directly below the root portion (used in the directional solidification of alloys) and may also have a filler cup forming portion 38 above the airfoil portion. If this filler cup is provided it is located above the top of the central element as shown in FIG. 2. The wax pattern extends beyond the side margins of the surfaces 20 and 22 on the central mold element to establish surfaces 40 and 41 on one pattern and 42 and 43 on the other pattern. In this way, the cast blade halves have mating surfaces for use in bonding the blade halves together. The wax patterns may be preformed and then positioned on the mold element or may be cast in position on the central element if so desired.

Figure 3:
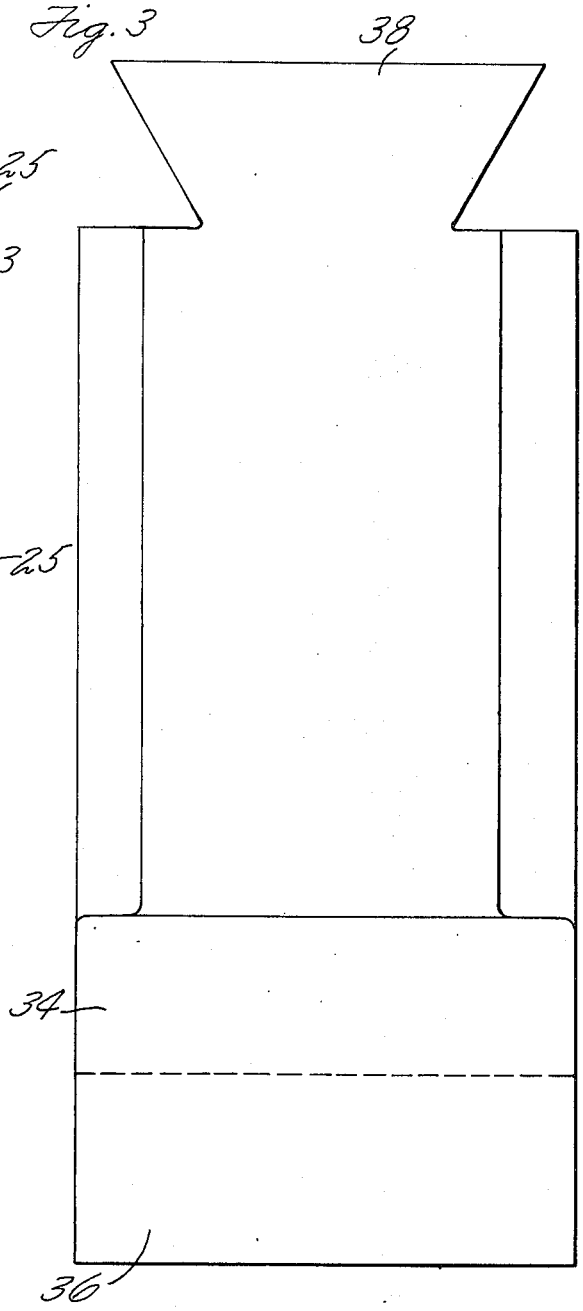
FIG. 3 is a side elevation of the assemblage of FIG. 1, showing the growth zone and filler cup at opposite ends of the assemblage.
Figure 6:
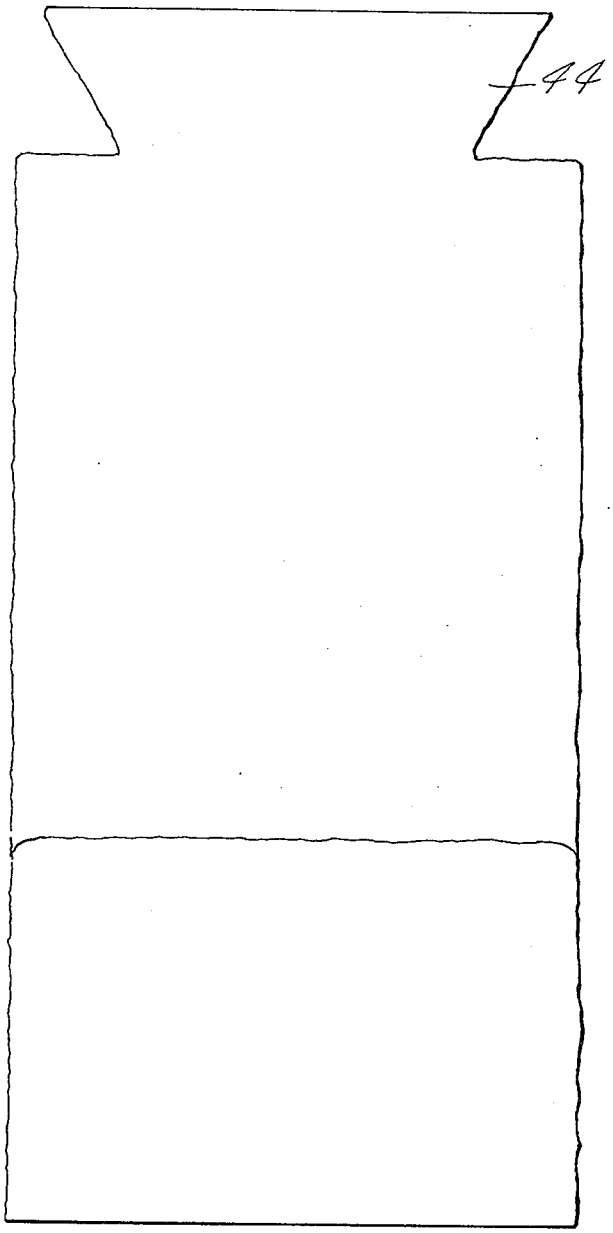
FIG. 6 is an elevation of the mold of FIG. 6 ready for making a casting.

This assemblage of central mold element and wax patterns thereon as in FIG. 3 is then used to make a shell mold 44. This process is well known and involves successively and repeatedly dipping the assemblage in a slurry of ceramic particles followed by stuccoing with refractory particles to coat the assemblage and then drying the coating, the repetition of dipping, stuccoing and drying being repeated until the desired thickness for a mold wall is obtained. The assemblage with the multiple coatings thereon is then heated for hardening and curing to form the coatings into a firm strong mold to be used in making the casting. The mold, FIG. 6, encompasses the filler cup and growth zone as well as the remainder of the assemblage.

Figure 5:
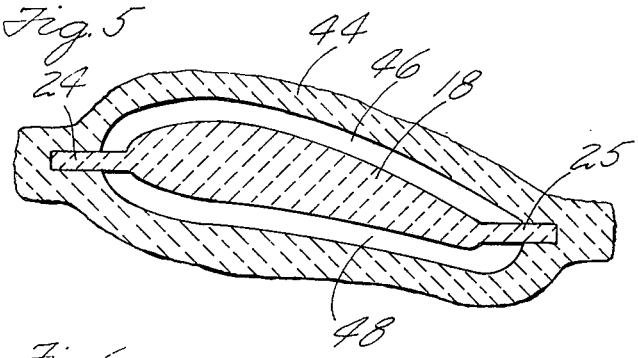
FIG. 5 is a view similar to FIG. 1 with the wax pattern removed.
Figure 7:
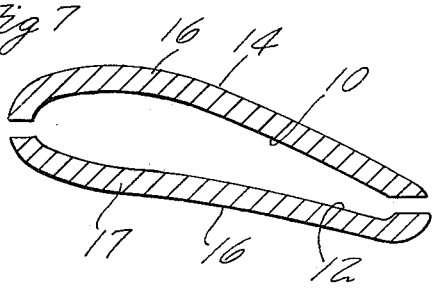
FIG. 7 is a sectional view through the opposed halves of the cast blade before assembly into a finished blade.

During the heating of the assemblage and coatings, the wax pattern is melted and flows out of the hardened mold leaving a cavity on each side of the "strong back", such cavities 46 and 48, FIG. 5, corresponding in shape, as will be apparent, to the opposed halves of the blade to be cast. The growth zone cavity at the bottom of the mold terminates at the open bottom end of the mold, and the filler cavity is open at the top end of the mold.

Figure 4:
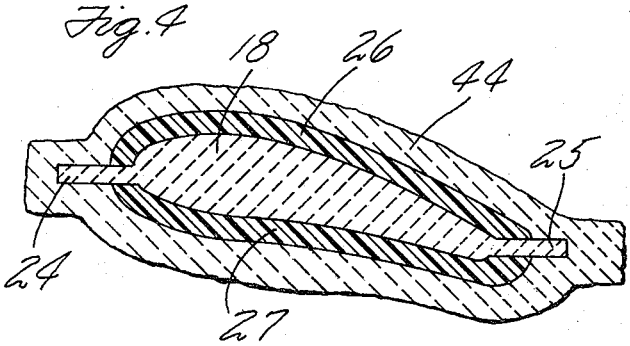
FIG. 4 is a view similar to FIG. 1 with a mold formed thereon.

If the articles to be cast are made from one of the super alloys the completed mold, with the "strong back" therein, and held by the flanges 24 and 25 which extend into and are embedded in the mold wall as shown in FIGS. 4 and 5 is then positioned on a chill plate and placed within a vacuum or inert gas chamber. In this chamber, the mold is raised to a temperature above that of the alloy to be cast, the alloy is poured into the mold and the alloy is solidified by the action of the chill plate and by the controlled cooling of the mold. If columnar grained or single crystal articles are being cast the cooling is accomplished as described in VerSnyder or Piearcey, above mentioned. It will be understood that the invention is also applicable to the production of equiaxed castings.

Figure 9:
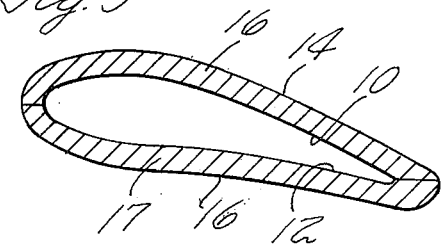
FIG. 9 is a sectional view of the finished blade.

When the alloy is cooled, the blade halves are removed from the mold, and when cleaned and the extraneous material removed, for example the growth zone alloy and filler cup alloy, the opposed blade halves are bonded together to form the turbine blade of FIGS. 8 and 9. Because the strong back is not deformed during the casting process, the mating surfaces 50 and 52 on the opposing blade halves, formed by the areas of the central mold element that were in contact with the surfaces 40, 41, 42 and 43 of the pattern, and exposed when the pattern was melted out of the mold, are precision surfaces and will mate over the entire design area of each surface for a full-area bonding of the two halves together. The blade being cast in halves may have its internal surfaces and the blade wall thicknesses carefully inspected prior to assembly to make sure that the blade when completed is within the precision limits required for optimum performance in use.

This invention has particular utility at the present time in the production of high temperature turbine blades and vanes. These parts have been manufactured in significant quantities by investment casting, using the "lost wax" technique and such experience has been obtained that a large portion of the castings made will meet the high standard established for the safe use of such parts. The present concept is substantially an extension of the same technique but including the reinforcing "strong back" or center mold element. Thus this invention requires development of no significant new techniques and the expertise already obtained may be adapted directly to the present concept. It will be understood that much development work is necessary in adapting new molds and processes for successful commercial use. The present concept is an effective interim invention that may be extensively utilized until the more sophisticated concept of the above identified application Ser. No. 416,563 can be put into high production of precision parts.

Although the invention has been shown and described with respect to a preferred embodiment thereof, it should be understood by those skilled in the art that various changes and omissions in the form and detail thereof may be made therein without departing from the spirit and the scope of the invention.

Having thus described typical embodiments of our invention, that which we claim as new and desire to secure by Letters Patent of the United States is:

1. In the manufacture of a mold for use in precision casting of mating thin walled parts from high temperature alloys, the steps of providing a precast, high strength central mold element of adequate strength to avoid deformation during heating and casting of the said mold element having article forming surfaces on opposite surfaces thereof and edge flanges extending beyond the article forming surfaces and the wax patterns, positioning individual wax patterns on opposite sides of the element, one on each article forming surface of the element, forming a shell mold around the assembled mold element including the edge flanges and the patterns on the element by successively dipping the element with the patterns thereon in a ceramic slurry, stuccoing with refractory particles to form a coating and drying the coating to form the desired shell thickness, and heating the shell mold to harden it and to melt out the wax patterns in readiness for making a casting therein, the central mold element retaining its shape and dimension during such heating.

2. The process of claim 1 in which the outer surfaces of the wax pattern define the other article forming surface.

3. The process of claim 1 in which the central mold element has edge flanges extending beyond the wax patterns to be engaged with and embedded in the shell mold formed on the assembled element and patterns.

4. The process of claim 1 in which the wax patterns are preformed before positioning on the mold element.

5. The process of claim 1 in which the wax patterns are molded on opposite sides of the central element.

6. A mold for use in casting thin walled parts including a precast refractory, high strength central element having article forming surfaces, one on each side thereof and edge flanges extending beyond the article forming surfaces, this element having adequate strength to maintain shape and dimension within the remainder of the mold during heating and casting of the finished mold, an investment mold of ceramic material surrounding said central mold element and defining on opposite sides of the central element an article forming cavity, one surface of each of which is the central element and the other surface of which is formed by a part of the investment mold, and the edge flanges of the central element projecting into and being embedded in the investment mold.

7. A mold as in claim 6 in which the central element is a ceramic having high strength and deformation resistant characteristics to produce precise mating surfaces on articles cast in the cavities.

8. A mold as in claim 6 in which the central element is precision molded and hardened prior to the formation of the investment mold around it.

9. A mold as in claim 6 in which at least portions of the article forming surfaces on opposite sides of the mold element are precisely parallel to one another to define mating surfaces on the opposed cast articles.

10. A mold as in claim 6 in which the investment mold comprises a plurality of overlapping layers of ceramic material in intimate contact with each other and with the several layers differing from the material of the mold element.

11. In the manufacture of hollow cast articles the steps of forming a precast mold element of high strength ceramic, said element having mating article forming surfaces on opposite sides thereof, forming an investment mold around the mold element with the investment mold having article forming surfaces in juxtaposition to the article forming surfaces on the mold element and defining therewith article cavities on opposite sides of the central element for the formation of mating articles, heating the assembled mold element and investment mold, casting articles in the article cavities, the central mold element having adequate strength to retain its shape and dimension within the mold during the mold heating and pouring to assure precise dimension and shape of the mating articles, and bonding the opposed cast articles together on the surfaces formed against the central element.

12. The process of claim 11 including the step of positioning wax patterns on the central element prior to forming the investment mold, the wax patterns defining the article cavities.

13. The process of claim 11 in which the mold element has edge flanges, and including the step of embedding the edge flanges in the investment mold during the formation thereof.

14. The process of claim 12 including the step of melting out the wax pattern before casting the articles in the mold cavities.

15. The process of claim 11 including the step of making portions of the article forming surfaces on opposite sides of the central element in precise parallel relation to one another to form mating surfaces on the cast articles.

* * * * *